US010173862B2

(12) United States Patent
Colombano et al.

(10) Patent No.: US 10,173,862 B2
(45) Date of Patent: Jan. 8, 2019

(54) METHOD FOR OPERATING AN ELEVATOR CONTROL DEVICE INCLUDING SENDING AN AUTHORIZATION CODE

(71) Applicant: Inventio AG, Hergiswil NW (CH)

(72) Inventors: Claudio Colombano, Ennetbürgen (CH); Adrian Bünter, Giswil (CH); Andrew Paice, Baden-Dättwil (CH); Philipp Lüthi, Ebikon (CH); Thomas Räber, Lucerne (CH)

(73) Assignee: INVENTIO AG, Hergiswil (CH)

( * ) Notice: Subject to any disclaimer, the term of this patent is extended or adjusted under 35 U.S.C. 154(b) by 404 days.

(21) Appl. No.: 15/023,067

(22) PCT Filed: Sep. 15, 2014

(86) PCT No.: PCT/EP2014/069595
§ 371 (c)(1),
(2) Date: Mar. 18, 2016

(87) PCT Pub. No.: WO2015/039984
PCT Pub. Date: Mar. 26, 2015

(65) Prior Publication Data

US 2016/0229665 A1 Aug. 11, 2016

(30) Foreign Application Priority Data

Sep. 18, 2013 (EP) ..... 13184959

(51) Int. Cl.
*B66B 1/20* (2006.01)
*B66B 5/00* (2006.01)
*B66B 1/34* (2006.01)

(52) U.S. Cl.
CPC ..... *B66B 5/0087* (2013.01); *B66B 1/3423* (2013.01); *B66B 5/00* (2013.01); *B66B 2201/406* (2013.01)

(58) Field of Classification Search
CPC ..... B66B 5/0087; B66B 1/3423; B66B 5/00; B66B 2201/406
USPC ..... 187/247, 380–388, 391–393
See application file for complete search history.

(56) References Cited

U.S. PATENT DOCUMENTS 5,616,894 A * 4/1997 Nieminen ..... B66B 1/34 187/247
6,330,935 B1 * 12/2001 Systermans ..... B66B 5/0025 187/391
7,172,055 B2 * 2/2007 Engel ..... B66B 5/0087 187/391

(Continued)

FOREIGN PATENT DOCUMENTS

JP 2044099301 A 4/2004
JP 2010228907 A 10/2010

(Continued)

*Primary Examiner* — Anthony Salata
(74) *Attorney, Agent, or Firm* — William J. Clemens; Shumaker, Loop & Kendrick, LLP

(57) ABSTRACT

A process for operating an elevator control device, whereby for local access to the elevator control device via a programming device, the elevator control device automatically sends an identifier to the programming device and the identifier is input to an operator panel associated with the elevator control device. The elevator control device permits the local access when the previously sent identifier has been entered correctly within a predetermined input time.

11 Claims, 4 Drawing Sheets

(56) References Cited

U.S. PATENT DOCUMENTS

| | | | | |
|---|---|---|---|---|
| 7,353,915 | B2 * | 4/2008 | Zaharia | B66B 1/468 187/388 |
| 8,770,350 | B2 * | 7/2014 | Wilke | B66B 1/468 187/247 |
| 9,403,663 | B2 * | 8/2016 | Dellarippa | B66B 1/34 |
| 9,802,788 | B2 * | 10/2017 | Miyajima | B66B 1/468 |
| 9,850,093 | B2 * | 12/2017 | DePaola | B66B 1/468 |
| 9,896,304 | B2 * | 2/2018 | Flynn | B66B 1/468 |
| 9,944,492 | B2 * | 4/2018 | Lustenberger | B66B 5/0031 |
| 2003/0080851 | A1 | 5/2003 | Gerstenkorn | |
| 2009/0119762 | A1 * | 5/2009 | Thomson | G07C 9/00031 726/7 |
| 2011/0247901 | A1 | 10/2011 | Wilke et al. | |
| 2016/0152439 | A1 * | 6/2016 | MacDonald | B66B 1/46 187/384 |
| 2018/0157482 | A1 * | 6/2018 | Kirchhoff | B66B 1/34 |

FOREIGN PATENT DOCUMENTS

| | | | |
|---|---|---|---|
| WO | 2012062957 | A1 | 5/2012 |
| WO | 2014048826 | A1 | 4/2014 |

* cited by examiner

METHOD FOR OPERATING AN ELEVATOR CONTROL DEVICE INCLUDING SENDING AN AUTHORIZATION CODE

FIELD

The invention primarily relates to a method for operating an elevator control device in an installation mode, an initialization mode or maintenance mode or the like. In addition, the invention also relates to a computer program for implementing the method and a computer program product with such a computer program and a device, for example an elevator control device, with such a computer program as a means for carrying out the method.

BACKGROUND

In the case of modern elevator control devices, access to these is possible by means of a device designated hereafter as a programming device without affecting its general validity in other respects. The term access here is meant to be understood as preferably the activation or deactivation of elevator functions, and temporary or permanent changes in the program sequence or the adjustable parameters of the elevator control device. The access can be performed locally, if qualified personnel with an appropriate programming device are present on site. Access can also be made from a remote station, for example over the internet. It goes without saying that in the case of remote access to the elevator control device, for security reasons individual functions of the elevator control device, such as the opening of landing doors, must not be accessible.

SUMMARY

An object of the present invention is accordingly to specify a method for operating an elevator control device that allows a reliable detection of a local access to the elevator control unit.

This object is achieved according to the invention with a method for operating an elevator control device. For this purpose in such a method, in which the elevator control device comprises an interface to the wireless and/or wired access to the elevator control device by means of a programming device, the following is provided: During access, or in connection with the access to the elevator control de-vice by means of the programming device, a code is automatically sent to the programming device. The code can be sent, for example, by the elevator control device to the programming device. It is also possible, for example, that during access to the elevator control device by means of the programming device, a code is sent by a third device to the programming device and also to the elevator control device. On the basis of the transmitted code the elevator control device expects an input of the previously sent code to a control panel within a specified or specifiable entry time period, wherein the control panel is arranged in the area of the elevator system, cooperates with the elevator control device and facilitates the inputting of the code only by contact or from a short distance. For this purpose, a control panel of the kind that is provided with an elevator system on each floor of the building is preferably used (landing control panel; Landing Operating panel—LOP), or a control panel of an elevator car (Car Operating panel—COP). The elevator control device automatically checks the entered code by comparing it for a match, or at least a sufficient match, with the code that was previously sent and the elevator control device automatically enables access to the elevator control device if the previously sent code has been correctly entered within the entry time period. If the elevator control device does not send the identifier itself, it is provided that the elevator control device also receives the code sent externally to the programming device and can therefore check the subsequent entry of the code. Sending of the code by the elevator control device is thereby understood to mean a direct transmission by the elevator control device, but also an indirect transmission, namely under the control of the elevator control device, wherein, for example, a device in the elevator car designed for the purpose functions as a transmitter.

As an entry time period a comparatively short time value is normally selected, for example a time value in the order of several seconds, for example thirty seconds. This ensures that, if the code is not successfully entered within the entry time period, no access to the elevator control device is enabled. The enabling is therefore only possible at all if it is closely synchronized with the transmission of the code by the elevator control device. This prevents accidental enabling if the code, which may already have been sent by the elevator control device days or weeks earlier, is randomly guessed from inputs made at a control panel. A comparatively large time value can also be selected as an entry time period however, for example a time value in the order of several minutes. A very large time value, for example a time value in the order of months or years, means that no monitoring at all takes place of whether the entry of the code is closely synchronized with the sending of the code. In this respect, for the interpretation of the description it can be assumed that the monitoring of the entry time period can also be omitted.

The invention is based on the consideration that in the case of local access to the elevator control device, technical personnel are present on-site to carry out the installation, initialization, maintenance etc. of the elevator system. The technical personnel ensure that the measures performed as part of the installation, initialization, maintenance etc. do not endanger personal safety. Therefore, in the case of such local access to the elevator control device, access can also be provided to functions that must not be available during remote access to the elevator control device. An example of such a function is the opening of the doors to landings already mentioned.

For reliable detection of a local access to the elevator control device it is therefore necessary to establish that technical personnel are present on site. If, in the event of an attempt to access the elevator control device, the elevator control device sends a code to the device with which the access attempt was initiated, whereupon the device—which here means the programming device—directly or indirectly causes the code to be output, the technical staff can enter the received code at a control panel of the elevator control device located in the area of the elevator system. If the entry is correct, it is established that technical personnel are present on site. The extended, local access to the elevator control device can then be enabled.

The main advantage of the invention is the simple manner in which a local access to the elevator control device can be detected. No evaluations of device codes and the like or maintenance of a list of permitted devices are required, nor also are transit time measurements for data exchanged between the programming device and the elevator control device. The detection of the local access to the elevator control device is therefore easy to implement and yet secure.

In the case of one embodiment of the method, the enabling of the access to the elevator control device terminates automatically after a specified or specifiable access time period. This avoids security risks such as might arise if the enabling of the access to the elevator control device is not terminated manually when the latter is no longer needed by the technical personnel.

The enabling of access to the elevator control device can be terminated by the technical staff entering a corresponding code at a control panel. If the technical staff terminates the operating actions on the elevator control device with such an entry, this ensures that the enabling of the local access to the elevator control device is terminated.

A particularly simple way to enter the code received by the elevator control device on the elevator control device is for the technical personnel to manually enter the code by means of a keypad which either the elevator control device comprises or which is as-signed to the elevator control device. The term entry however is to be given a broad interpretation and includes any form in which the code can be communicated to the elevator control device. In this respect, an automatic evaluation is also a possibility to be considered. Examples in this respect are a visually evaluable code and an acoustically evaluable code.

One exemplary embodiment of the method therefore provides that the programming device comprises in particular optical, acoustic or haptic actuator technology to output the received code in a form that can be evaluated automatically, that the control panel has sensor technology for detecting the code sent to the programming device and that the programming device is placed in the detection range of the sensor and the sensor detects the code that is sent to the programming device and output by means of the actuator. The output of the code received by the elevator control device in a form that can be evaluated automatically and the detection and subsequent evaluation with suitable sensor technology has the advantage that, for example, entry errors such as are possible in the case of manual input of the code on a keypad or the like, are avoided. Nevertheless, such an "entry" of the code at the control panel also allows the presence of technical staff on site to be reliably detected, because the respective actuators must be placed in the detection range of the respective sensors by the technical personnel.

In a special variant of this embodiment of the method, the programming device comprises means for the visual display of the code, in particular in the form of a barcode, as the actuator technology. The code received by the elevator control device is displayed by means of the actuators in a visually assimilable manner. The control panel comprises means for optically detecting the code displayed in this manner, in particular a camera. To "enter" the code the programming device, that is at least the respective actuators, is placed in the detection range of the sensors and the visual display of the code is detected by means of the sensors.

In an alternative or additional variant of the special embodiment of the method de-scribed above, as the actuators the programming device comprises means for acoustically representing the code, in particular for displaying/outputting the code in the form of a tone sequence. As the sensor, the control panel includes means for acoustically detecting the code "displayed" in this way, in particular an acoustic transducer, for example a microphone. To "enter" the code, the programming device, that is to say at least the respective actuators, is placed in the detection range of the sensors and the acoustic display of the code is detected by means of the sensors.

The object cited above is also achieved with an elevator control device and a programming device which are configured to execute the method and some or all of the variants of the method. The invention is preferably implemented in software. The invention is therefore both a computer program with program code instructions executable by means of a computer, namely the elevator control device and the programming device, and also a storage medium having such a computer program, that is to say a computer program product with program code means, and finally also an elevator control device and a programming device, into the memory of which such a computer program is loaded or can be loaded as a means for implementing the method and its variants. The method described here and hereafter is automatically executed partly by the elevator control device and partly by the programming device. If the text does not expressly contain references to other subject matter, each method step is to be read such that it is automatically executed by the elevator control device or the programming device on the basis of and under the control of a control program executed thereby.

In the following an example of the invention is explained based on the drawing. Equivalent objects or parts are assigned the same reference numerals in all figures.

The, or any, exemplary embodiment is not to be understood as a limitation of the invention. Rather, within the context of this disclosure, amendments and modifications are also possible which are evident to the person skilled in the art in regard to achieving the object of the invention, for example by combination or variation of individual features or elements or method steps described in connection with the general or specific description section and contained in the claims and/or the drawing, and which by combinable features lead to new subject matter or to new methods or sequences of method steps.

DESCRIPTION OF THE DRAWINGS

They show.

DETAILED DESCRIPTION

Figure 1:
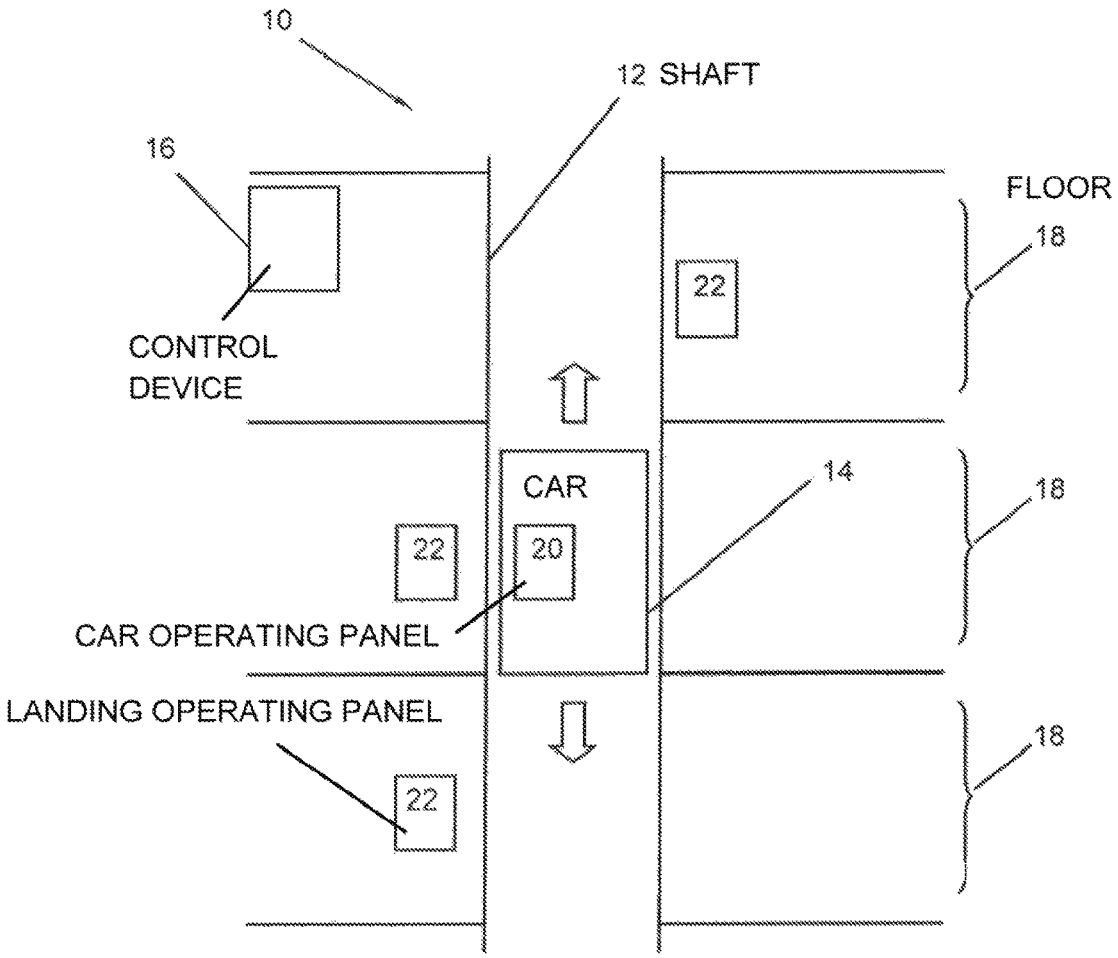
FIG. 1 is a schematic diagram of an elevator system with an elevator control device.

The illustration in FIG. 1 shows a simplified schematic diagram of an elevator system 10 in a building, not itself shown, with at least one elevator car 14 that can move in at least one elevator shaft 12 and an elevator control device 16 provided at a central point of the building. The elevator control device 16 is provided in a known manner for controlling the elevator system 10. The or each elevator car 14 is moveable in a known manner in the elevator shaft 12 or in the respective elevator shaft 12, so that different floors 18 of the building are accessible.

For a user of the elevator system 10, different control panels 20, 22 are provided, namely at least one car operating panel 20 (COP) and a control panel on each floor 18; landing operating panel 22 (LOP). Data lines and the like between the control panels 20, 22 and the elevator control device 16 are not shown in FIG. 1. The user of the elevator system 10 sends a travel request to the elevator control device 16 by way of operator actions at a control panel 20, 22 and as soon as the travel request can be satisfied, the elevator control device 16 causes a corresponding movement of the elevator car 14.

The present invention relates to an access to the elevator control device 16, as is required for example during the installation, regular maintenance operations, during a service or the like. Such an access to the elevator control device 16 is carried out by appropriately trained technical personnel, i.e. not by the user mentioned above.

During access to the elevator control device 16 by the technical personnel, it is often necessary, for example, that the elevator car 14 is moved or that landing doors (not shown) or car doors (not shown) of the elevator car 14 are opened or closed. Such measures, of which only examples are given here, involve security risks. For example, a landing door on one of the floors 18 of the building must not simply be opened if it involves a risk for users of the building.

Technical personnel can recognize these or similar hazards and act accordingly to mitigate them. But this normally only applies when the technical personnel are present on-site. With the present description a solution is proposed as to how the presence of specialist personnel on site can be recognized while accessing the elevator control device.

Figure 2:
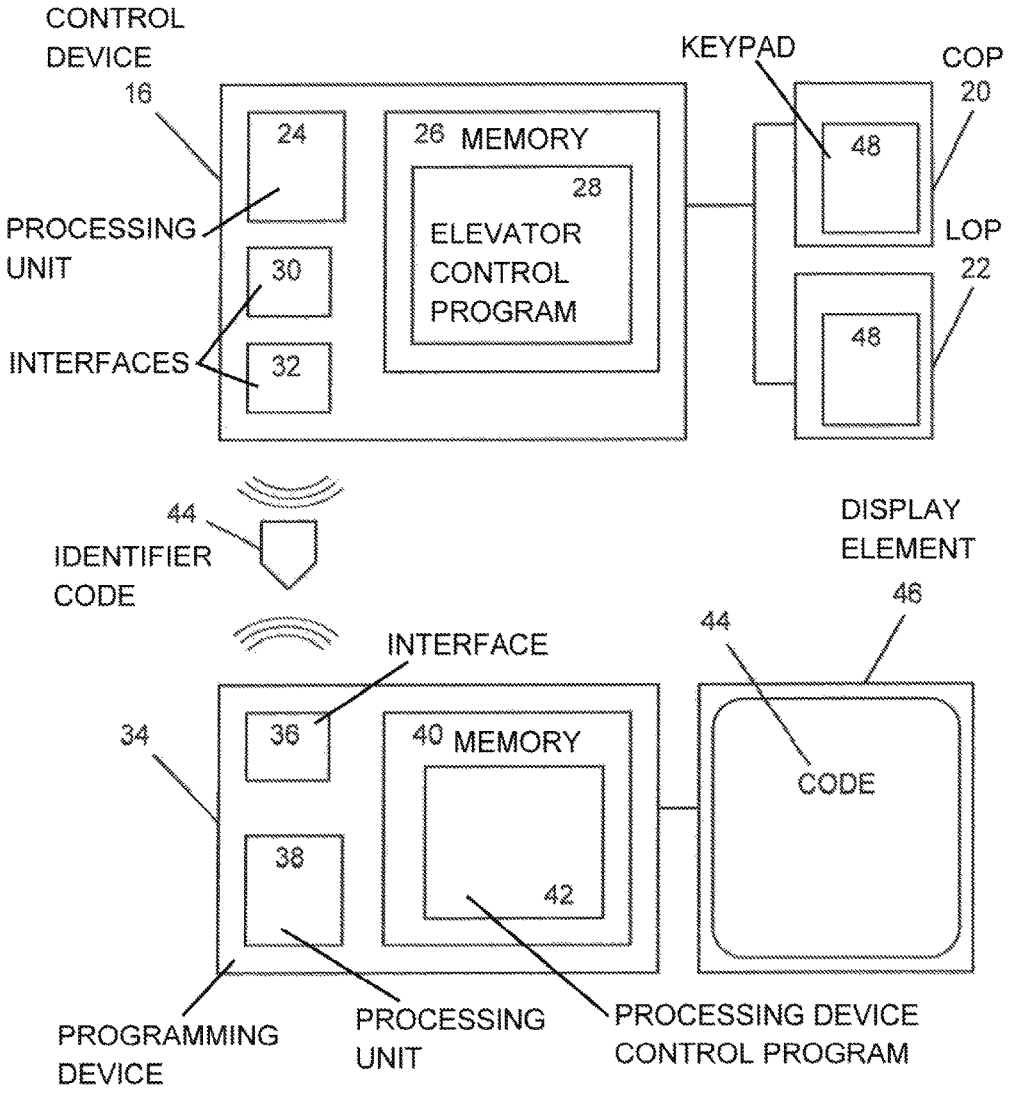
FIG. 2 is a block diagram of the elevator control device with further details and a programming device provided for access to the elevator control device.

The illustration in FIG. 2 shows the elevator control device 16 still in schematically simplified form, but with further details. Accordingly the elevator control device 16 comprises in a known manner a processing unit 24 in the form of or in the manner of a micro-processor and a memory 26. In the memory 26 an elevator control program 28 is loaded, which determines the functionality of the elevator system 10 (FIG. 1).

To access the elevator control device 16 this comprises at least one interface 30, 32. In the illustration in FIG. 2 for simple visualization of the proportions two independent interfaces 30, 32 are shown, namely a first interface 30 and a second interface 32. It is also possible that the elevator control device 16 comprises only one interface or more than two interfaces. The following embodiments then refer to one and the same interface of the elevator control device 16.

It is to be assumed here that the elevator control device 16 comprises two independent interfaces 30, 32 and that the first interface 30 enables, for example, a wired access to the elevator control device 16. Such a wired access using the first interface 30 can also be made by technical personnel from a remote site so that the wired access comprises, for example, a data transfer via the internet or the like, and the elevator control device 16 is connected in an appropriate manner by means of the first interface 30 to a communication medium that allows such a remote access.

By contrast the second interface 32 allows access to the elevator control device 16 using a dedicated device, referred to hereafter without affecting its general validity in other respects as a programming device 34 and which for access purposes is located in the immediate vicinity of the elevator control device 16 (local access). In the simplified schematic view in FIG. 2 such a programming device 34 is shown in the lower area. The programming device 34 has a programming device interface 36 matching the second interface 32 of the elevator control device 16, so that a data exchange is possible between the elevator control device 16 and the programming device 34. In addition the programming device 34 comprises in a known manner a processing unit 38 in the form of or in the manner of a microprocessor and a memory 40. In the memory 40 a programming device control program 42 is loaded, which determines the functionality of the programming device 34.

To illustrate the access to the elevator control device 16 using the programming device 34, in the view shown in FIG. 2 wavefronts emitted by the respective interfaces 32, 36 are shown. Thus the interfaces 32, 36 enable, for example, a wireless communication between the programming device 34 and the elevator control device 16. Equally, the access to the elevator control device 16 by means of the programming device 34 can be made via wired means. The interfaces 32, 36 are then designed accordingly.

Not shown is the fact that, in addition or alternatively, individual or all operator panels 20, 22 can have an interface 30, 32 for access to the elevator control device 16, namely at least one interface 32 for local access to the elevator control device 16. When in the following, according to the illustration in FIG. 2 mention is made of an interface 32 for access to the elevator control device 16 by means of the programming device 34, this is intended also to include access to the elevator control device 16 by means of an interface 32 comprised by the elevator control device 16 itself as well as access to the elevator control device 16 by means of an interface (not shown) comprised by a control panel 20, 22.

The following section relates to the local access to the elevator control device 16 by means of a programming device 34. Because the programming device 34 is operated by technical personnel, in the case of local access to the elevator control device 16 the respective technical personnel are present on the site of the elevator system 10. Local access to the elevator control device 16 can therefore allow execution of functions that are not available in the case of a remote access. In this context the example of opening the landing doors already mentioned above can be cited. In the case of remote access it must not be possible to open the landing doors, because this would result in—as is clearly apparent—a risk to the users of the building. In the case of a local access, opening the landing doors for maintenance purposes and the like may be required and the concomitant fundamental danger remains manageable because the technical personnel are present on-site and appropriate measures can be taken to protect and inform the users of the building.

The elevator control device 16, which irrespective of the nature of the specific access comprises as part of its elevator control program 28 the functionalities of, for example, opening the landing doors, must therefore be able to distinguish between a local and a remote access, so that certain functions that are not accessible to a remote access are accessible to a local access.

To achieve this it is provided that during access to the elevator control device 16 by means of the programming device 34 the elevator control device 16 sends a code 44 to the programming device 34 automatically—that is on the basis of a corresponding partial functionality of the elevator control program 28. The elevator control device 16 expects an entry of the previously sent code 44 within a specified or specifiable entry time period at a control panel 20, 22 comprised by the elevator control device 16 or assigned to the elevator control device 16. If the previously sent code 44 has been entered correctly within the entry time period, the elevator control device 16 enables access, namely local access, to the elevator control device 16.

The code 44 is usually a variable code 44, which cannot be easily guessed and which also changes from time to time, so that opportunities for misuse are largely eliminated. In a particular embodiment the code 44 is an individual code 44 for each access to the elevator control device 16 newly formed by means of a programming device 34, for ex-ample in the form of or based on a random number.

If the code 44 sent by the elevator control device 16 to the programming device 34 by means of the programming device 34 in connection with the access to the elevator control device 16 is subsequently, and specifically within the specified or specifiable entry time period, entered correctly at the elevator control device 16 or one of the control panels 20, 22, then this is evaluated to check whether the technical personnel who gave rise to access to the elevator control device 16 by means of the programming device 34 are present at the site of the elevator system 10, so that the extended local access to the elevator control device 16 can be granted.

So that the technical staff can recognize the code 44 sent to the programming device 34 and then enter it at the elevator control device 16 or at one of the control panels 20, 22, different means for outputting the code 44 sent by the elevator control device 16 at the programming device 34 and different means of detecting the code 44 that was entered are possible.

The drawing shown in FIG. 2, for example, is a situation in which the programming device 34 is assigned in a known manner a display element 46 in the form of a monitor or the like, if the programming device 34 does not already comprise such a display element 46 as an integral component. Using the display element 46, the code 44 received by the elevator control device 16 is recognizable to the human user, i.e. to the technical personnel operating the programming device 34. In the drawing of FIG. 2 the representation of the code 44 by means of the display element 46 is illustrated by the character string "CODE", as an example of a code 44, being shown in the area of the display element 46. The code 44 can be formed either exclusively of alphanumeric characters, exclusively of numeric characters or combinations of alphanumeric and numeric characters, and where appropriate of combinations of alphanumeric and numeric and so-called special characters. The readable word "CODE" as the code 44 is therefore explicitly only intended as an example and has been primarily chosen to make it easy to distinguish the representation of the code 44 from the reference numerals used elsewhere in the drawing of FIG. 2. To enter the code 44 at the elevator control device 16, in particular at one of the control panels 20, 22, the respective control panel 20, 22 comprises a keypad 48 which is not shown in detail.

Figure 3:
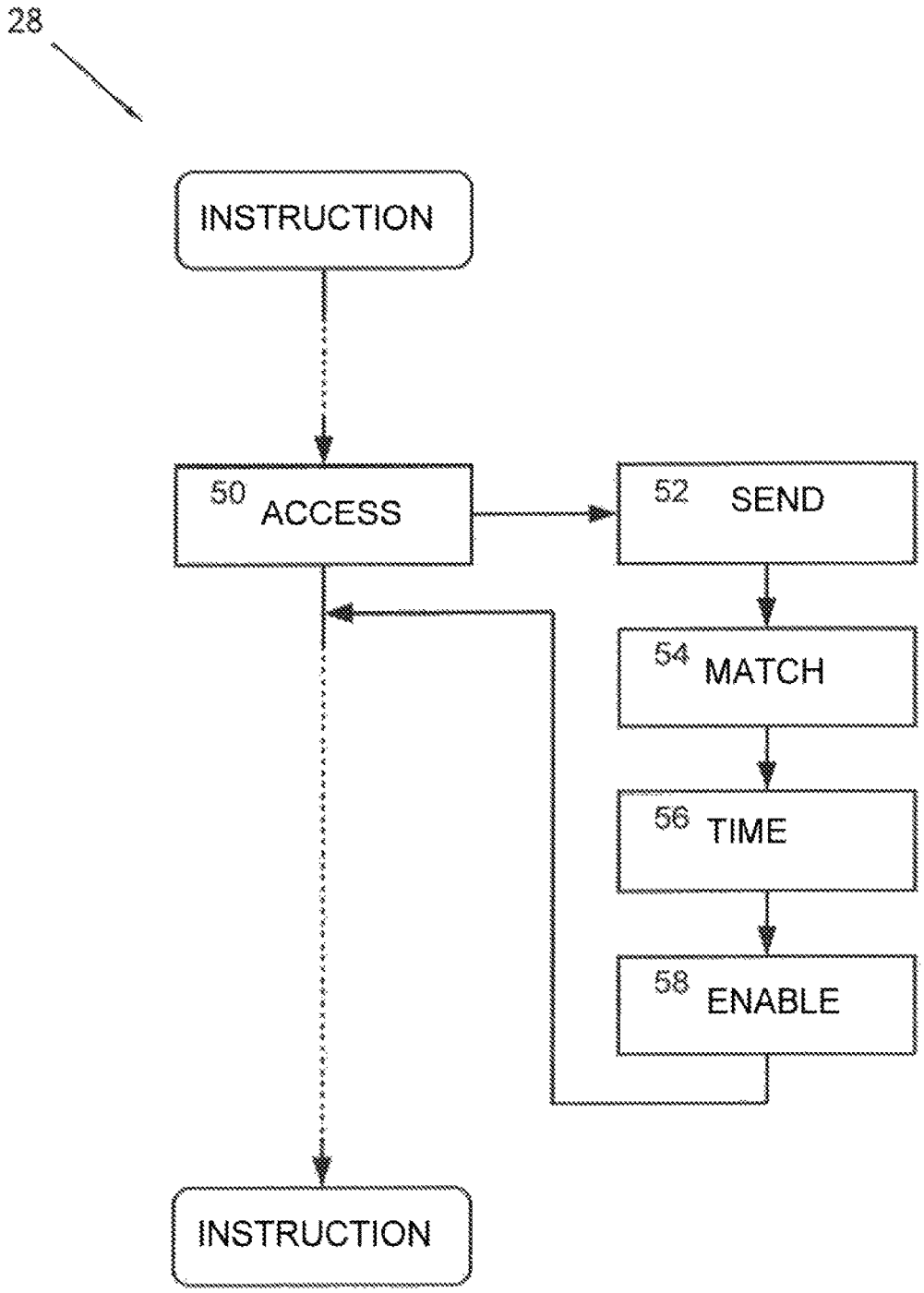
FIG. 3 is a flow diagram relating to part of the functionality of an elevator control program executed by the elevator control device and FIG. 4 is a block diagram generalized view of the elevator control device and the programming device of FIG. 2.

The processing sequence of the method for obtaining local access to the elevator control device 16 by means of a programming device 34 present at the location of the elevator control device 16 is shown in schematic simplified form in the drawing of FIG. 3 by means a flow diagram for a part of the elevator control program 28. According to this diagram, during the execution of the elevator control program 28 by the processing unit 24 of the elevator control device 16, an attempt to access the elevator control device 16 using a programming device 34 is detected (first step 50). Then the flowchart branches to a sub-function of the elevator control program 28, in which in a second step 52 the elevator control device 16 sends a code 44 to the respective programming device 34. The branching to this second step 52 need not immediately follow the detection of the attempt to access the elevator control equipment 16. Likewise it can also be provided that the elevator control program 28 first continues to run and only responds to the access attempt by branching to this second step 52 later, at an appropriate time, thus for example when the elevator system is in a particular configuration. In a third step 54, it is checked whether an entered code 44 matches the originally transmitted code 44. If such a correspondence is found, in a fourth step 56 it is checked whether the entry is made within the entry time period. If both conditions are met, the local access to the elevator control device 16 can be enabled (fifth step 58). The elevator control program 28 then branches back to its normal processing sequence.

At this point it should be noted that the representation of the flow diagram is only a schematic representation of the relevant partial functionality of the elevator control program 28. In the case of a concrete implementation, for example, the query as to whether the entry is made within the entry time period can be omitted if, after expiry of the entry time period the system automatically branches to the normal processing sequence of the elevator control program 28.

Figure 4:
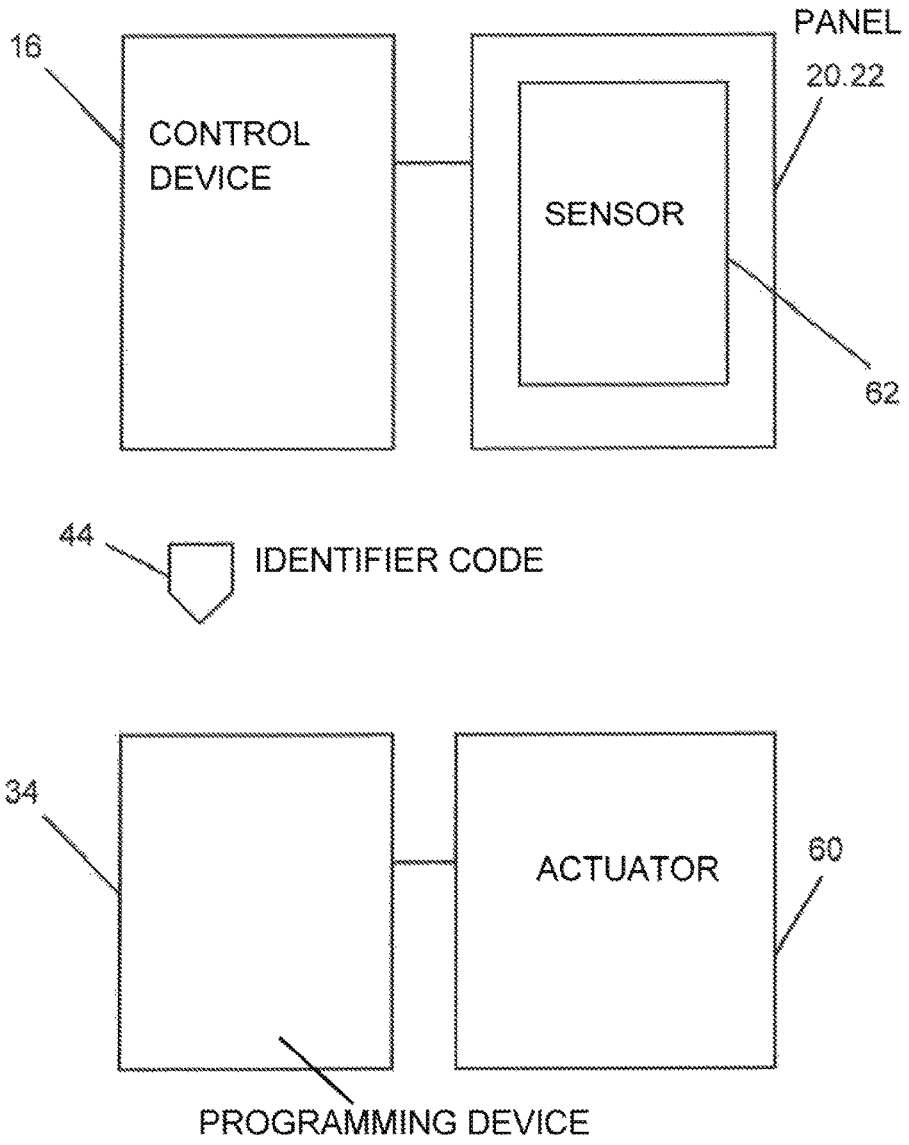

The drawing in FIG. 4 is in part of a repetition of the drawing of FIG. 2, but without the repeated reproduction of details of the elevator control device 16 and the programming device 34.

The drawing in FIG. 4 is intended to show that the programming device 34 comprises as its actuators 60 means for visual displaying the code 44 and/or means for acoustically "displaying" (outputting) the code. The display element 46 was already shown in FIG. 2 as an example of an actuator 60 for visually displaying the code 44. The display can also be shown, for example, on a personal mobile device carried by technical personnel, such as a mobile radio, by the elevator control device 16 or the programming device 34 sending the code 44 to such a mobile device. As an example of an actuator 60 for acoustically displaying/outputting the code 44, one possible option is a loud-speaker which outputs the code 44 emitted by the elevator control device 16 as a tone sequence with tones of different frequencies and/or a signal sequence with acoustic signals of a constant frequency but with varying duration and/or with tones of different frequencies and/or of varying duration.

The sensor technology 62 for detecting the code 44 is implemented in the case of the control panel 20, 22, for example, by the keypad 48 already mentioned and hereafter generally designated as the sensor 62. The entry of the code 44 using such a sensor 62 has already been described. As an alternative or additional means to detect the code 44, a sensor 62 for optically detecting the code, such as a camera, could be considered. In this manner, by means of the sensor 62 an image of the code 44 received by the elevator control device 16 is detectable on a display element 46 and detected when the code 44 is entered. Such an automatic detection of a representation of the code 44 emitted by the elevator control device 16 allows a wide range of types of display for the code 44, for example, a representation of the code 44 in the form of a barcode, in the form of a 2D code, in the form of a flicker code and so on, also including representations that cannot be readily interpreted by technical personnel. A further possible alternative or additional means for detecting the code 44 is a sensor 62 for the acoustic detection of the code 44, in particular a sensor 62 in the form of an acoustic transducer. In that case, for detecting the code 44 an acoustically emitted code 44 is detectable by means of the respective sensor 62 and in operation is detected by means of this sensor 62.

Although the invention has been illustrated and described in greater detail by means of the exemplary embodiment, the invention is not restricted by the example or examples disclosed and other variations can be derived therefrom by a person skilled in the art without departing from the scope of protection of the invention.

Individual key aspects of the description submitted here can therefore be briefly summarized as follows:

A method is specified for operating an elevator control device 16, in which in the case of access to the elevator control device 16 by means of a programming device 34, the elevator control device 16 automatically sends an identifier or code 44 to the programming device 34, wherein the elevator control device 16 expects an entry of the previously sent code 44 at a control panel 20, 22 comprised by the elevator control device 16 or assigned to the elevator control device 16 within a specified or specifiable entry time, and wherein the elevator control device 16 enables access to the elevator control device 16 if the previously sent code 44 has been entered correctly within the entry time period.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for operating an elevator control device comprising the steps of:

wherein the elevator control device has an interface for at least one of wireless and wired access to the elevator control device by a programming device, said programming device storing and operating a computer program that can activate or deactivate elevator functions and provide temporary or permanent changes in an elevator programming sequence for an elevator system;

wherein for local access to the elevator control device by the programming device so as to program the elevator system the elevator control device automatically detects that the programming device is attempting to access the elevator control device and automatically sends a code to the programming device in response thereto;

wherein the elevator control device checks for entry within a predetermined entry time period of the previously sent code at a control panel in communication with the elevator control device; and wherein the elevator control device enables the local access to the elevator control device by the programming device if the previously sent code has been entered correctly within the predetermined entry time period at the control panel.

2. The method according to claim 1 wherein the enabling of the local access to the elevator control device terminates automatically after expiration of a predetermined access time period.

3. The method according to claim 1 wherein the enabling of the local access to the elevator control unit is terminated in response to a corresponding code being entered at the control panel or another control panel in communication with the elevator control device.

4. The method according to claim 1 wherein the control panel includes a sensor for detecting the code sent to the programming device, wherein the programming device includes an actuator for outputting the received code in a form that can be evaluated automatically and wherein the programming device is placed within a detection range of the sensor and the sensor detects the code sent to the programming device.

5. The method according to claim 4 wherein the actuator visually displays the code as a barcode in a visually assimilable manner, and wherein the sensor optically detects the displayed code.

6. The method according to claim 4 wherein the actuator acoustically represents the code as a tone sequence in an acoustically assimilable manner, and wherein the sensor acoustically detects the acoustic code.

7. A computer program product with program code means for carrying out the method steps according to claim 1 when the computer program is executed by at least one of the elevator control device and the programming device.

8. A computer program product with program code means stored on a non-transitory computer-readable data medium for carrying out the method steps according to claim 1 when the computer program product is executed by at least one of the elevator control device and the programming device.

9. An elevator control device comprising:

a memory in which the computer program for performing the method according to claim 1 is loaded; and a processing unit connected to the memory for executing the computer program to operate the elevator control device.

10. A programming device for enabling local access to an elevator control device, the programming device having a memory in which a computer program for performing the method according to claim 1 is stored, and a processing unit connected to the memory for executing the computer program to operate the programming device.

11. The programming device according to claim 10 having at least one of a display element for optically outputting the code and an actuator for acoustically outputting the code.

* * * * *